US005735965A

United States Patent [19]

Baldi

[11] Patent Number: 5,735,965

[45] Date of Patent: Apr. 7, 1998

[54] METHOD FOR THE REMOVAL OF PAINT FROM WHEEL HUBS

[75] Inventor: Valter Baldi, Bologna, Italy

[73] Assignee: Reynolds Wheels International Ltd., Lugano, Switzerland

[21] Appl. No.: 574,511

[22] Filed: Dec. 19, 1995

[30] Foreign Application Priority Data

May 15, 1995 [EP] European Pat. Off. ..... 95830198

[51] Int. Cl.[6] ..... B08B 5/00; B08B 5/04; B08B 9/00

[52] U.S. Cl. ..... 134/21; 134/22.1; 134/22.12; 134/32; 134/33; 134/37; 134/38; 134/25.4

[58] Field of Search ..... 134/10, 21, 37, 134/22.12, 33, 32, 25.4, 38

[56] References Cited

U.S. PATENT DOCUMENTS 3,805,317 4/1974 Dickinson ..... 15/306 B
3,915,739 10/1975 Maahs ..... 134/21
5,361,493 11/1994 Baldi ..... 29/894.324
5,429,422 7/1995 Baldi ..... 301/65

FOREIGN PATENT DOCUMENTS

WO 88/09234 12/1988 WIPO .

*Primary Examiner*—Zeinab El-Arini
*Attorney, Agent, or Firm*—Darby & Darby

[57] ABSTRACT

Paint applied to a wheel electrostatically in the dry state is removed subsequently from the hub by a method of which the first step is to block the hub from one side with a plate, offered to a first face of the wheel and of shape such that it combines with the substantially cylindrical bore of the hub to create a chamber which remains accessible from the opposite face of the wheel. A jet of air is then generated close to the hub and introduced into the chamber, investing the cylindrical surface directly or indirectly or obliquely and creating a turbulence sufficient to remove the unwanted layer of paint; at the same time, suction is generated at least in the part of the chamber flooded with air, in such a way as to aspirate and recover the particles of paint removed from the hub and held in suspension by the resulting swirl.

10 Claims, 3 Drawing Sheets

METHOD FOR THE REMOVAL OF PAINT FROM WHEEL HUBS

BACKGROUND OF THE INVENTION

The present invention relates to a method for the removal of paint from wheel hubs, and to equipment for the implementation of such a method, intended as a manufacturing aid in the production of wheels, and in particular as part of the painting cycle in the manufacturing process.

In the art field of wheel manufacture, and more especially the production of wheels with superior functional and styling features, typically alloy wheels, the manufacturing process comprises the step of painting the wheel.

After being formed, whether pressed, pressure die cast or forged, the wheels are washed, dried and then painted, for example electrostatically.

To this end, the structure or body of the wheel is electrified with one polarity and the paint with the opposite polarity, so that the paint, which is applied in the dry state (powder or granules), will cling to the surfaces of the wheel by electrostatic attraction.

Thereafter, the paint undergoes heat treatment in ovens, the purpose being generally to bring about a process of polymerization or polycondensation by which it is hardened and rendered insoluble. One of the problems resulting from processes of this type is that particles of the paint find their way onto the substantially cylindrical surface defining the bore of the hub.

In effect, the hub is proportioned to match a given size axle, and designed to accommodate the axle in its bore substantially without any clearance in the radial direction. In particular, the wheel may be fashioned with a pilot hole, that is, an annular profile by means of which the wheel is located on and aligned with the corresponding axle. This means that any imperfections exhibited by the surface of the hub destined to interact with the axle, however slight, are markedly significant when considering the high quality specifications to which wheels of the type in question are expected to have.

It is the practice currently for traces of paint remaining on the hub to be removed manually by an operator who inserts a brush or similar implement into the bore and eliminates the unwanted particles by generating movement with the brush substantially in an axial direction relative to the wheel. Not only is a procedure of this type disadvantageous in that it requires manual labour, by reason of the painting cycle not being fully automated, but there is also the undesirable risk of paint being chipped away from the circular edge where the hub meets the exposed face of the wheel. This defacement leaves an area around the bore of the hub compassed by an irregular outline and exhibiting a colour or, in any event, a shade of colour dissimilar to the remainder of the wheel, which has a negative impact on the appearance of the wheel overall.

Accordingly, the object of the present invention is to provide a method and relative equipment for the removal of paint from wheel hubs, in particular the removal of electrostatically applied powders, such as will be devoid of the drawbacks mentioned above.

SUMMARY OF THE INVENTION

The stated object is realized in a method for the removal of paint from wheel hubs in accordance with the present invention, which comprises the initial step of blocking the hub from one side through the agency of blocking means applied to a first face of the wheel and shaped in such a manner as to combine with at least one substantially cylindrical surface of the hub in creating a chamber having one side open to a second face of the wheel opposite to the first; this is followed by the steps of generating a jet of air close to the cylindrical surface of the hub, designed to invest the surface directly or indirectly or obliquely and produce turbulence in such a way as to remove the layer of paint covering the surface, and generating a negative pressure at least in the part of the chamber flooded by the jet of air in such a way as to aspirate and recover the paint removed from the hub and held in suspension by the air in that part of the chamber.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
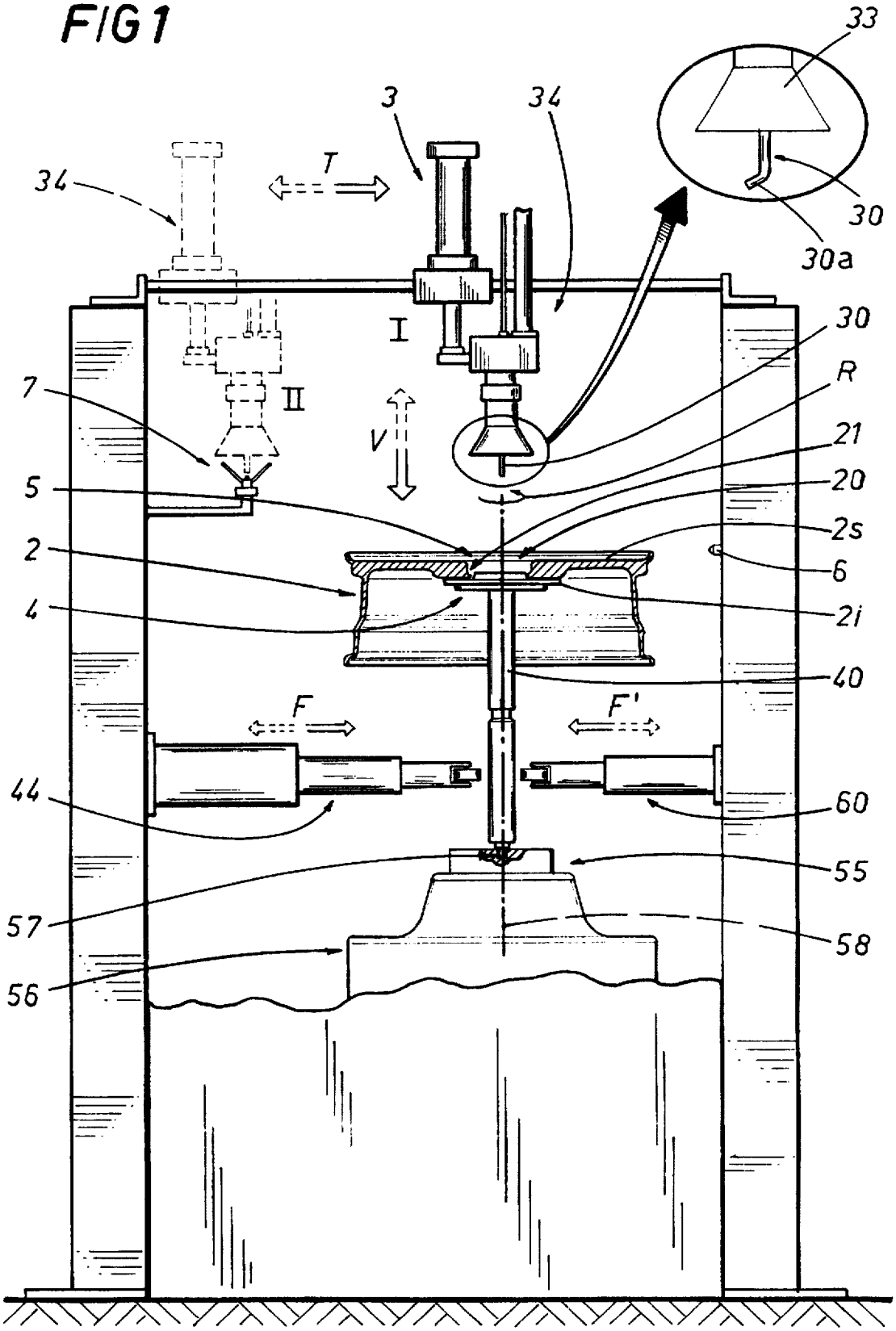
FIG. 1 shows a possible embodiment of equipment according to the present invention, illustrated schematically in a side elevation.

Referring to the accompanying drawings, the present invention relates to a method of removing paint from wheel hubs, and in particular to the removal of electrostatically applied powders, utilizing equipment, denoted 1 in the drawings, to which the present invention likewise relates.

Among the principal applications for such a method, accordingly, is the removal of electrostatically applied paint from wheel hubs, and in particular from the annular portion constituting the part of the hub associated directly with the axle.

The method disclosed comprises at least the steps now to be described.

In a first step, the hub 20 is blocked from one side through the agency of blocking means 4 applied to a first face 2*i* of the wheel 2 ("i" indicating lower, or downward facing, in the drawings); the means 4 in question are shaped in such a way as to combine with at least one substantially cylindrical surface 21 of the hub 20 in creating a chamber 5 that opens onto the second, opposite face 2*s* of the wheel 2 ("s" indicating upper or upward facing).

The cylindrical surface 21 might be provided by the pilot hole of the wheel, of which more will be said in due course.

The second step consists in generating a jet of air close to the cylindrical surface 21 of the hub 20, by which the surface is invested either directly or indirectly or obliquely, producing turbulence in such a way as to remove the layer of paint covering the surface.

The third step is one of creating negative pressure at least within the part of the chamber 5 invested by the air jet, in such a way that the paint lifted from the surface 21 and held in suspension by the resulting swirl is aspirated and recovered.

In addition, the method might include the expedient of supporting the wheel 2, both during the painting operation and during the step of removing surplus paint from the hub 20, by means of a substantially upright shaft 40. As illustrated schematically in FIG. 1, in particular, the shaft 40 is carried in a vertical position by conveying means 55 forming part of a production line 56 and moving along a path denoted P in FIG. 4, which are conventional in embodiment and therefore described no further. The bottom end 57 of the shaft 40 is supported loosely by the conveying means 55, i.e. with a degree of clearance, in such a way that the shaft is allowed a small measure of oscillatory movement relative to its own vertical axis 58. This particular feature will be discussed further in due course.

The top end of the shaft 40 carries a plate 4 that functions as the aforementioned blocking means 4, as will emerge in due course. The plate 4 affords a bearing surface on which to position the internal or first face 2*i* of the wheel 2, and exhibits a substantially frustoconical spigot 41 of which the larger base is associated with the plate 4.

The spigot 41 is proportioned to locate internally of the hub 20 but without touching the cylindrical surface 21, and in particular without touching the pilot hole.

Accordingly, the plate 4 can be positioned in such a way as to block the hub 20 and combine with the cylindrical surface 21 to create the chamber 5.

The jet of air is generated in close proximity to the cylindrical surface 21, so as to invest both the surface 21 and the spigot 41 of the plate 4, generating a turbulence of which the effect is to remove the layer of paint covering the spigot 41 and the surface 21. Dislodged by the action of the air and held in suspension, the paint is recovered by generating a partial vacuum in the chamber 5 as already intimated.

This is an especially significant feature of the method disclosed, in as much as the removal of the paint from the spigot 41 means that the one plate 4 can be used for several paint spray cycles. Indeed without this step of the method, the paint applied to the wheel would also accumulate on the plate 4, causing the diameter of the spigot 41 to increase progressively to the point that it could no longer be inserted freely into the hub 20 after relatively few cycles.

To advantage, moreover, the operations involved in removing the paint can be performed within a period of time equivalent to the basic indexing step of the manufacturing process, so that there need be no variation in operating speed and a substantially continuous production tempo is achieved.

Figure 2:
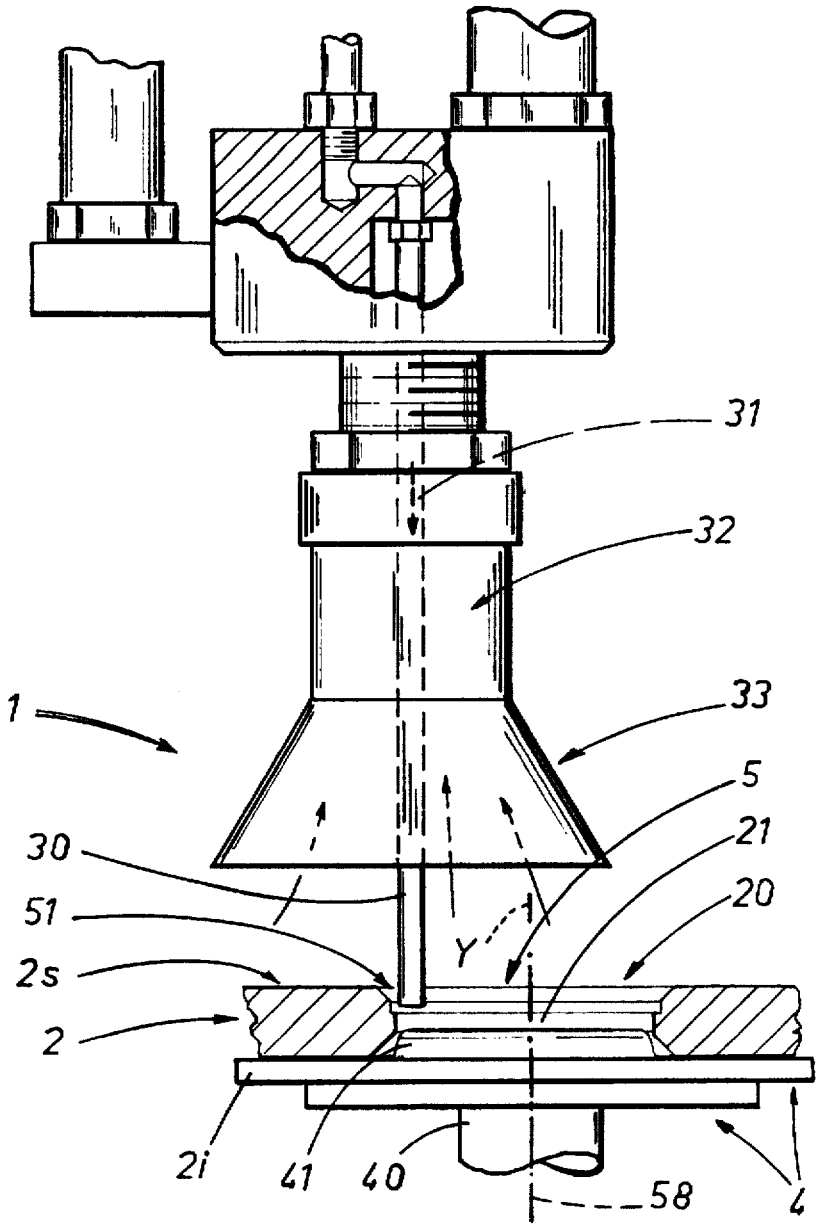
FIG. 2 shows a detail of the equipment of FIG. 1, illustrated schematically in a side elevation.
Figure 3:
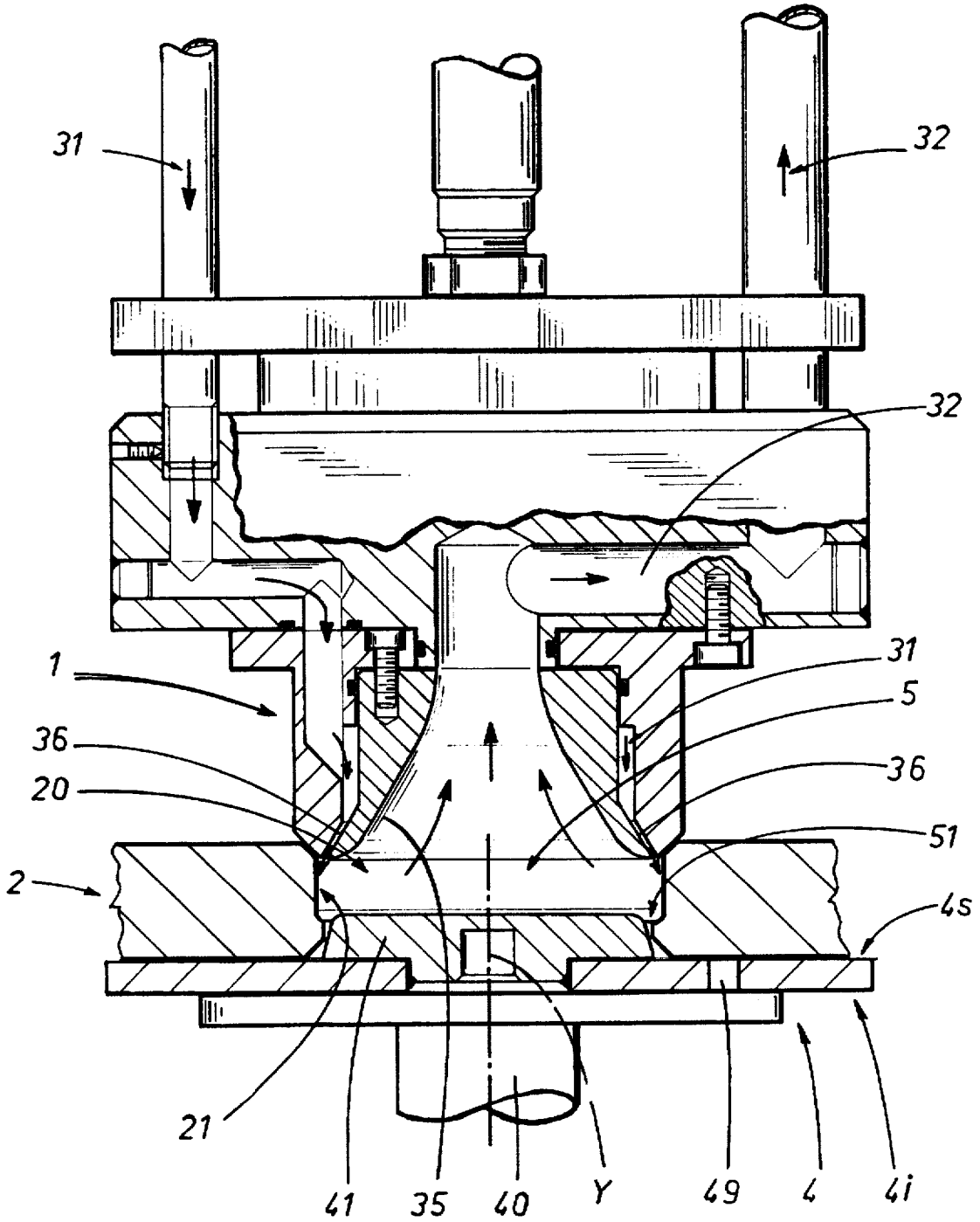
FIG. 3 shows a further possible embodiment of equipment according to the invention, illustrated schematically in a side elevation.

FIGS. 2 and 3 illustrate two different examples of equipment according to the invention, both of which are capable of implementing the method described above.

The equipment 1 in question is composed essentially of an element appearing as a disc, or plate 4, and pneumatic means 3 comprising two distinct circuits.

As already intimated, the surface of the plate 4 positioned to interact with the wheel 2 exhibits a profile complementing that of the hub 20, so that when offered to a first face 2*i* of the wheel 2, the plate 4 functions as an element by means of which to close off the bore of the hub 20.

The pneumatic means 3 comprise a first circuit 31 serving to generate a jet of air, and a second circuit 32 serving to generate a negative pressure.

These dual circuits 31 and 32 are positioned so as to bear against the face of the wheel 2 opposite to the supporting face or first face offered to the plate 4 (in the drawings, the wheel 2 is supported by way of the inner or lower face 2*i*, whilst the pneumatic means 3 operate on the side of the outer or topmost face 2*s*).

Accordingly, the function of the pneumatic means 3 is to interact with the chamber 5 encompassed by the plate 4 and the cylindrical surface 21 of the hub 20: the first and second circuits 31 and 32 serving respectively to remove and to recover the paint present on the cylindrical surface 21.

As discernible from the drawings, and as mentioned previously in describing the method to which the invention relates, the plate 4 can be embodied with a substantially frustoconical spigot 41 disposed with the larger circular base offered to the plate and insertable into the hub 20 without touching the relative cylindrical surface 21. In this way, with the air jet able to penetrate the space 51 between the spigot 41 and the cylindrical surface 21, the unwanted paint on the hub 20 and on the plate 4 can be removed and recovered.

Observing FIGS. 1 and 2, the first circuit 31 will be seen to comprise a nozzle 30 of which one end is introduced into the chamber 5 and directed at the space 51 between the spigot 41 and the cylindrical surface 21 of the hub 20.

More exactly, the nozzle 30 may be of substantially rectilinear appearance as in FIG. 2 and in the main drawing of FIG. 1, or fashioned as in the detail of FIG. 1, with an angled end 30*a* that will be directed toward the cylindrical surface 21 of the hub when the nozzle 30 is in the operating configuration.

The jet of air delivered by the rectilinear type of nozzle 30 produces a blast action applied along a direction predominantly parallel with the axis Y of the chamber 5, in such a way as to attack the layer of paint in a direction substantially coinciding with the longitudinal generators of the cylindrical surface 21.

In the case of a nozzle 30 with an angled end 30*a*, it is clear that the interaction between the air jet and the paint will occur obliquely in relation to the axis Y of the chamber.

Still referring to FIGS. 1 and 2, the second circuit or negative pressure circuit 32 of the pneumatic means 3 comprises a suction port 33 that consists in a frustoconical structure with an open bottom end extending coaxially with and externally of the nozzle 30 in such a way as to cap the chamber 5 in the manner of a hood which, if embodied with the appropriate shape, might combine in a substantially fluid-tight fit with the top face 2*s* of the wheel to enclose the chamber 5.

The dual circuit pneumatic means 3 are also carried by a structure 34 capable of movement between at least two positions or stations, along a direction indicated by the arrow denoted T in FIG. 1.

A first position, denoted I in FIG. 1, is occupied by the pneumatic means 3 when activated to remove the paint from the wheel 2; the remaining position, denoted II in FIG. 1, is a servicing position in which the pneumatic means 3 are freed of residual paint by the action of a cleaning tool 7 utilizing solvents, for example, of a type compatible with the particular paint in use, or other conventional mechanical or chemical aids.

The movable structure 34 can also alternate between at least two positions in the vertical or height dimension. In FIG. 1, for example, the structure 34 is capable of movement in a vertical direction V toward or away from the level at which the wheel 2 is stationed in readiness for the removal of paint from its hub 20.

If the nozzle 30 is fixed in the operating position as in FIGS. 1 and 2, there will be a rotation R of the wheel 2 about its axis Y so that the jet of air can interact with the cylindrical surface 21 of the hub 20 along a circular trajectory.

Figure 4:
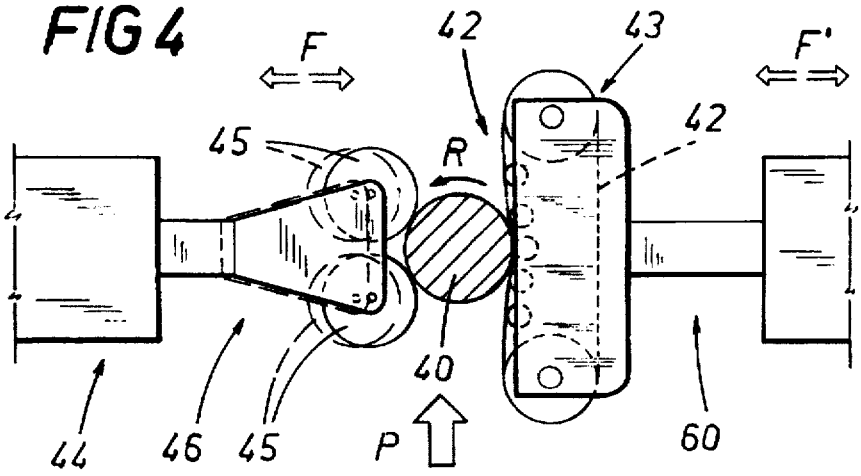
FIG. 4 shows a detail of equipment embodied in accordance with the present invention, illustrated schematically and viewed in plan from above.

To this end, the plate 4 is embodied in such a way as to support the wheel 2 and might be carried, as discernible also in FIG. 4, by a relative shaft 40 associated with rotational transmission means 42 coupled to corresponding drive means 43. Thus, the wheel 2 can be set in rotation R, at least when the dual circuit pneumatic means 3 are activated, and the nozzle 30 caused in consequence to interact with the cylindrical surface 21 of the hub 20 along the entire circumferential length of the latter.

In the particular instance of the equipment 1 being utilized in manufacturing systems where wheels 2 mounted to respective shafts 40 are advanced along the path P followed by the production line through successive work stations, through the agency of the aforementioned conveying means 55 by which the shafts 40 are carried, the transmission means 42 might consist in at least one drive belt disposed and operating in a substantially horizontal plane and mounted to a drive station 60.

The drive station 60 is positioned to one side of the production line, with the belt 42 facing the conveying path P and arranged in mutual opposition with a corresponding push rod assembly 44 located on the opposite side of the path P. One end 46 of the push rod assembly 44 carries at least two idle rollers 45 rotatable about vertical axes, and is capable of movement (in the direction denoted F in FIGS. 1 and 4) toward the drive station 60. Thus, the shaft 40 is pinched between the two rollers 45 and the belt 42, and set in rotation by frictional contact with the belt. The position of the push rod assembly 44 prior to its movement toward the drive station 60 is indicated by phantom lines in FIG. 4, whilst the plain lines illustrate the position of interaction with the shaft 40. The shaft is in fact capable of oscillating movement in relation to its own vertical axis, as already intimated, and will be set in rotation when forced into contact with the belt 42 by the push rod assembly 44.

In like manner, the drive station 60 is capable of movement toward the push rod assembly 44, in the direction denoted F' in FIGS. 1 and 4.

In the solution of FIG. 3, the suction port 35 of the second or negative pressure circuit 32 appears as a substantially bell-like structure and exhibits a maximum sectional area marginally smaller than the corresponding area of the hub 20, whilst the first or air jet circuit 31 comprises an outlet 36 consisting in a gap that extends coaxially with and externally of the suction port 35 and is arranged in such a way that the bell structure functions as a hood by which the chamber 5 can be enclosed in a fluid-tight seal.

The example of FIG. 3 also indicates an alternative embodiment of the plate 4, which is fashioned with at least one through hole 49 affording a passage between the top face **4*s*, on which the wheel 2 is supported, and the exposed bottom face 4*i***, through which the air and the paint removed from the wheel are able to exhaust.

As an alternative or in addition to the hole 49, the top face **4*s* of the plate 4 might also exhibit a toughened or non-uniform surface, in such a way as to create a gap between the wheel 2 and the plate 4** through which air and paint can be exhausted.

As a general feature, lastly, the activation of the air jet and the negative pressure can be triggered automatically by optical sensing devices 6 designed to identify the position of the wheel 2 along the path P determined by the production line 56; one such device 6 is indicated schematically in FIG. 1.

What is claimed is:

1. A method of removing paint, in particular electrostatically applied powders, from wheel hubs, comprising the steps of:

blocking the hub from one side with a blocking means applied to a first face of the hub, the blocking means being shaped to combine with at least one substantially cylindrical surface of the hub surrounding an opening of the hub to form a chamber having one side open to a second face of the hub opposite to the first face;

generating a jet of air into the chamber to contact the hub surface directly, indirectly or obliquely with the air and produce turbulence sufficient to remove unwanted layer of paint covering the hub surface; and generating a negative pressure in at least part of the chamber receiving the jet of air to aspirate and recover the paint removed from the hub and held in suspension by the air in that part of the chamber.

2. A method as in claim 1, further comprising the step of:

supporting the wheel during the step of removing the paint by a substantially upright shaft having a free end that carries a plate providing a bearing surface on which to position the first face of the wheel, and a substantially frustoconical spigot disposed with the larger base of the spigot nearer to the plate, said spigot being insertable into the hub opening without touching the hub cylindrical surface.

3. A method as in claim 2, wherein the jet of air is directed into a peripheral area of the chamber substantially encompassed between the cylindrical surface of the hub and the frustoconical spigot of the plate.

4. A method as in claim 1, wherein the jet of air produces a blast action contacting the hub surface in a direction substantially parallel to the longitudinal axis of the chamber and interacting with the paint in a direction substantially parallel to the hub surface.

5. A method as in claim 1, wherein both the jet of air and the negative pressure are generated internally in a hood such as said hood will combine with the second face of the wheel to enclose the chamber in a substantially fluid-tight fit.

6. A method as in claim 1, further comprising the step of rotating the hub about its own axis during the steps of generating the air jet and generating the negative pressure to cause the air jet to interact with the hub cylindrical surface along a circular trajectory.

7. A method as in claim 1, utilized in manufacturing systems where wheels are supported and advanced by conveying means along a path of a production line through successive work stations, wherein the step of blocking the hub is effected by a disc or plate associated with and carried by the conveying means and the plate having a frustoconical spigot which supports the hub and blocks the hub during the advancing movement along the path.

8. A method as in claim 1, wherein the jet of air and the negative pressure are produced by a dual circuit pneumatic means carried by a structure, and further comprising the step of moving the pneumatic means between at least a first position in close proximity to the hub at which the pneumatic means is activated and paint is removed from the hub, and a second position at which the pneumatic means is cleaned.

9. A method as in claim 1, wherein the steps of generating the jet of air and of generating the negative pressure are controlled automatically by an optical sensing device that identifies the position of the wheel along a predetermined path.

10. A method as in claim 1, wherein the steps of removing paint from the wheel hubs are performed within a period of time equivalent to the basic indexing step of the wheel manufacturing process.

* * * * *